US006792886B1

(12) United States Patent
Maloney et al.

(10) Patent No.: US 6,792,886 B1
(45) Date of Patent: Sep. 21, 2004

(54) PLANING LANDING CRAFT

(75) Inventors: Ken Maloney, New Orleans, LA (US); John Richards, Metairie, LA (US); Robert A. Stringer, Slidell, LA (US); Charles S. Whipple, Jr., Slidell, LA (US)

(73) Assignees: Biophan Technologies, Inc., West Henrietta, NY (US); Textron Systems Corporation, Wilmington, MA (US)

( * ) Notice: Subject to any disclaimer, the term of this patent is extended or adjusted under 35 U.S.C. 154(b) by 0 days.

(21) Appl. No.: 10/389,224

(22) Filed: Mar. 14, 2003

Related U.S. Application Data

(60) Provisional application No. 60/363,968, filed on Mar. 14, 2002.

(51) Int. Cl.[7] ..... B63B 35/00

(52) U.S. Cl. ..... 114/60; 114/70; 114/72

(58) Field of Search ..... 114/26, 60, 70, 114/271, 72, 259

(56) References Cited

U.S. PATENT DOCUMENTS

| | | | | |
|---|---|---|---|---|
| 2,341,866 A | | 2/1944 | Higgins | |
| 3,320,918 A | * | 5/1967 | Zalejski | 114/70 |
| 3,483,838 A | * | 12/1969 | Rath | 114/60 |
| 4,681,054 A | | 7/1987 | Rice et al. | |
| 6,487,981 B1 | * | 12/2002 | Burg | 114/67 A |
| 2002/0164231 A1 | * | 11/2002 | Lucas et al. | 414/137.4 |

* cited by examiner

*Primary Examiner*—Sherman Basinger
(74) *Attorney, Agent, or Firm*—Garvey, Smith, Nehrbass & Doody, L.L.C.; Charles C. Garvey, Jr.

(57) ABSTRACT

An improved landing craft includes a hull that supports bow and stern ramps for enabling vehicles to drive through during loading and unloading. The drive-through arrangement also enables the crew to load and unload the craft much faster and more easily than existing vessels. A ballasting arrangement can be used to trim the hull when it is to be beached or to be extracted and/or during loading/unloading.

67 Claims, 13 Drawing Sheets

PLANING LANDING CRAFT

CROSS-REFERENCE TO RELATED APPLICATIONS

Priority of our U.S. Provisional Patent Application Ser. No. 60/363,968, filed Mar. 14, 2002, incorporated herein by reference, is hereby claimed.

STATEMENT REGARDING FEDERALLY SPONSORED RESEARCH OR DEVELOPMENT

The invention disclosed herein was developed under Navy Contract Nos. N00024-01-C-2234 and N00024-02-C-2231. The government may have rights in this invention.

REFERENCE TO A "MICROFICHE APPENDIX"

Not applicable

BACKGROUND OF THE INVENTION

1. Field of the Invention

The present invention relates to landing craft. More particularly, the present invention relates to an improved landing craft having a planing hull that is particularly suited for military operations that includes the loading, unloading and marine transport of very heavy vehicles such as tanks, trucks and the like.

2. General Background of the Invention

Landing craft that are currently in use operate in a displacement mode. Such craft usually include a single ramp to allow loading and unloading of tanks and trucks. An example of a prior art landing craft is the U.S. Navy LCU 1640 class craft. Other landing craft are shown in patents listed in the following table as examples.

TABLE 1

| U.S. Pat. No. | TITLE |
|---|---|
| 4,080,922 | FLYABLE HYDROFOIL VESSEL |
| 4,681,054 | MARINE VESSEL LAND METHOD FOR TRANSPORTING A VEHICLE |
| 4,865,275 | LAND, WATER AND AIR CRAFT |
| 5,080,032 | MONOHULL FAST SEALIFT OR SEMI-PLANING MONOHULL SHIP |
| 5,129,343 | MONOHULL FAST SHIP |
| 5,231,946 | MONOHULL FAST SEALIFT OR SEMI-PLANING MONOHULL SHIP |
| 5,316,409 | PORTABLE BOAT SKIDWAY |
| 5,544,607 | MOVEABLE SPONSONS FOR HYDROFOIL WATERCRAFT, INCLUDING BOTH LARGE EXTENDED-PERFORMANCE HYDROFOIL WATERCRAFT AND LEAPING PERSONAL HYDROFOIL WATERCRAFT |
| 5,746,146 | SURFACE EFFECT PLANING PONTOON SEAPLANE (SEPPS) |
| 5,832,856 | MONOHULL FAST SHIP WITH IMPROVED LOADING MECHANISM |
| 6,000,358 | BEACHING BOW FOR LOADING PLATFORMS AND WATERCRAFT |
| 6,095,076 | HYDROFOIL BOAT |
| 6,167,829 | LOW-DRAG, HIGH-SPEED SHIP |
| 6,439,148 | LOW-DRAG, HIGH-SPEED SHIP |

BRIEF SUMMARY OF THE INVENTION

The landing craft of the present invention has been designed as simply as possible. The hull lines consist of developable surfaces, which simplify construction and repairs.

The bow and stern ramp systems can employ simple hydraulic winch stations and hinge pin connections, as opposed to articulated or ram actuated designs.

A drive-through arrangement enables a crew to load and unload the craft much faster and more easily than the prior known landing craft.

The landing craft of the present invention employs control station redundancy. The craft can be operated from either of the two control stations.

The craft is powered with one or more power units that can be engine powered waterjet systems installed on the craft to provide a rugged alternative to propellers. The waterjet system has one or more water jet intakes that feature bar gratings that prevent the ingestion of large debris and limit the possibility of impeller damage from underwater obstructions.

The hull of the can be manufactured with A588 high strength steel. This steel has a 25% higher yield strength than the A36. This higher strength allows for lighter plating with equivalent strength to be used. In addition, its corrosion resistant characteristics should help reduce maintenance efforts and increase the structural life of the craft.

The hull can be constructed of 5086 alloy, and other marine aluminum alloys. The natural corrosion-resistant characteristics of the aluminum help reduce overall maintenance efforts and increase the structural life of the craft.

The craft of the present invention has no moving components exposed below the bottom of the hull. All propulsion and maneuvering systems are protected by hull structural components, improving reliability and survivability.

Two unique functions of this craft are its ability to load and offload cargo from well deck ships (e.g., classes LSD-41, LSD-49, LHD-1, LPD-17, and LHA) to beaches. To assist the crew in completing these tasks safely and efficiently, the craft has been fitted with two control stations, each affording the operator excellent visibility. These features should allow the craft to back down at speeds approaching seven knots, hold its position in a 30-knot cross wind, or rapidly rotate in position. The increase in maneuverability will allow speed and ease of control during wet well and beaching evolutions.

BRIEF DESCRIPTION OF THE SEVERAL VIEWS OF THE DRAWINGS

For a further understanding of the nature, objects, and advantages of the present invention, reference should be had to the following detailed description, read in conjunction with the attached drawings which are identified as follows.

DETAILED DESCRIPTION OF THE INVENTION

Figure 1:
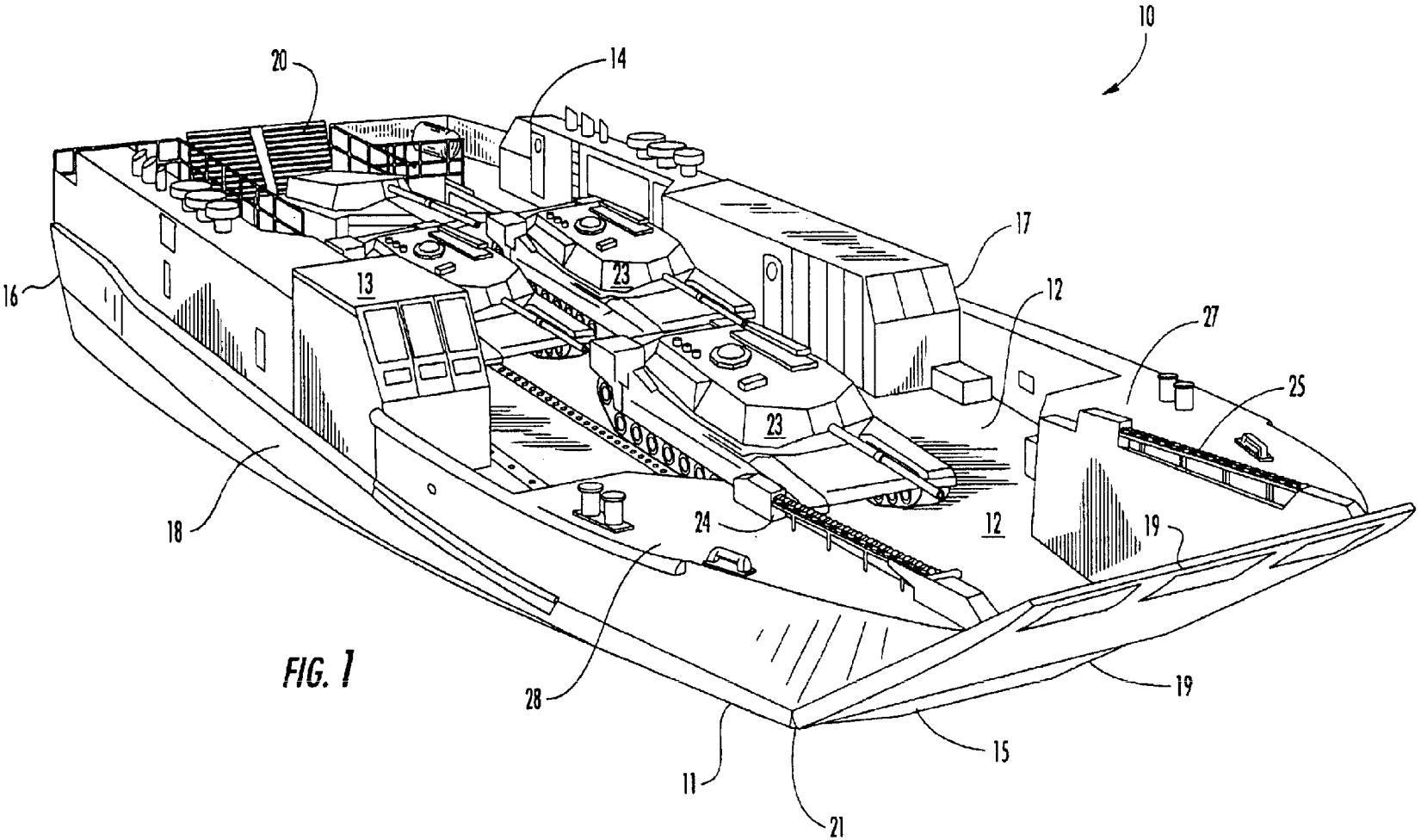
FIG. 1 is perspective view of the preferred embodiment of the apparatus of the present invention.
Figure 6:
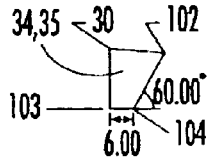
FIG. 6 is a fragmentary view of the preferred embodiment of the apparatus of the present invention illustrating the grounding rail portion.

The present invention provides an improved landing craft apparatus that is designated generally by the numeral 10 in FIGS. 1, and 25–30. Landing craft 10 provides a hull 11 that has a deck or deck area 12 with a starboard forward control station 13 and a port aft control station 14. Hull 11 includes bow 15 and stern 16 portions. Hull 11 has a port side 17 and starboard side 18 for reference purposes. The forward control station 13 is occupied by an operator or pilot for use when the craft 10 travels forward or when bow ramp 19 is to be raised or lowered. The aft control station 14 can be occupied by a pilot or operator for use when the craft 10 backs down or when stern ramp 20 is to be raised or lowered.

Bow ramp 19 is moveably (preferably pivotally) attached to hull 11. Bow ramp 19 can be pivotally attached to hull 11 at pivot 21. Stern ramp 20 is moveably attached to hull 11 at the vessel stern 16. Stern ramp 20 is preferably pivotally attached at pivot 22 to hull 11.

Figure 13:
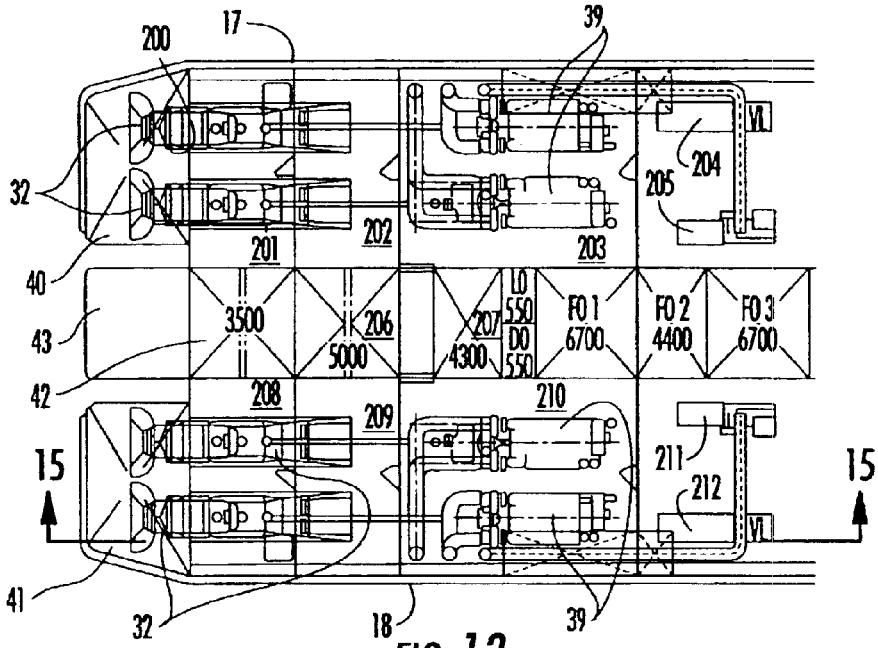
FIG. 13 is a partial cutaway plan view of the preferred embodiment of the apparatus of the present invention illustrating the hold plan, engines, and waterjets.
Figure 15:
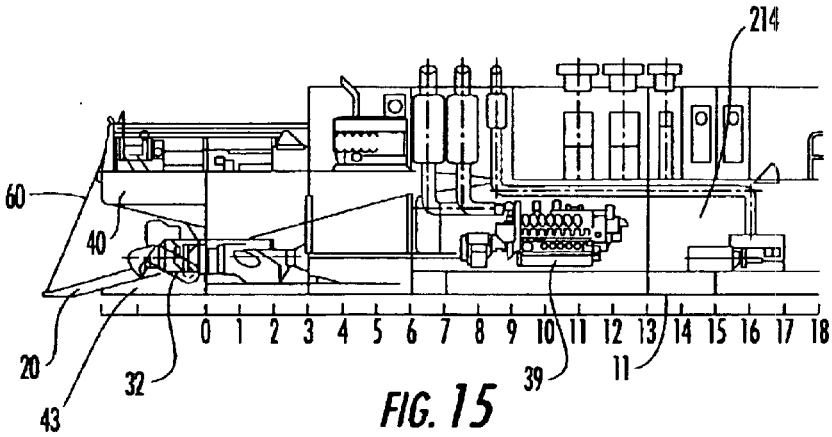
FIG. 15 is an elevation and partial cutaway view of the preferred embodiment of the apparatus of the present invention showing the hull stern portion and illustrating the engine and waterjet portions thereof.
Figure 16:
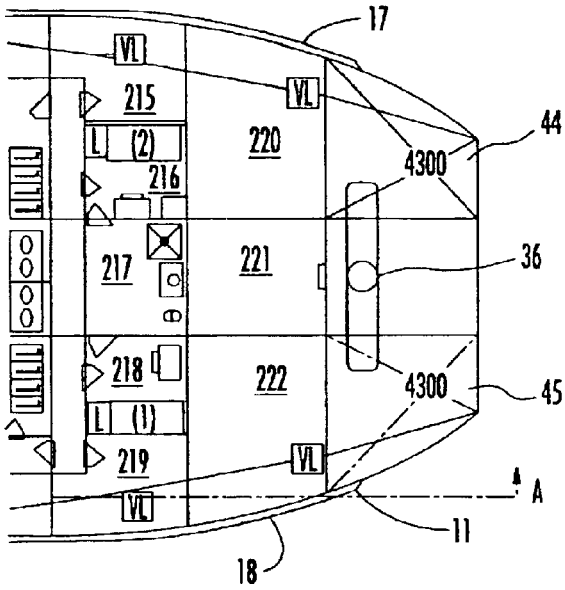
FIG. 16 is a partial cutaway plan view of the preferred embodiment of the apparatus of the present invention.
Figure 19:
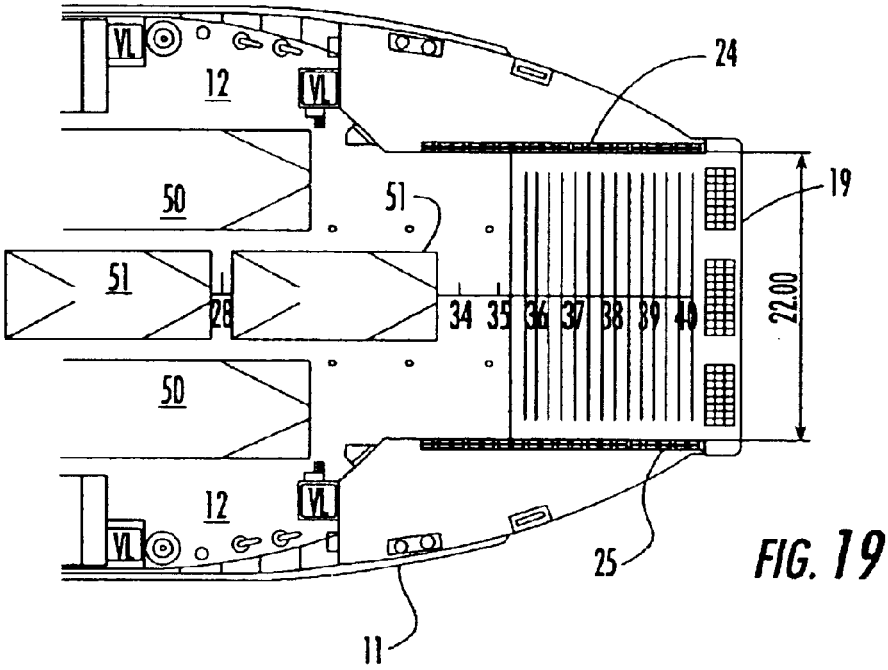
FIG. 19 is a partial plan view of the preferred embodiment of the apparatus of the present invention illustrating a typical cargo layout for the deck.
Figure 20:
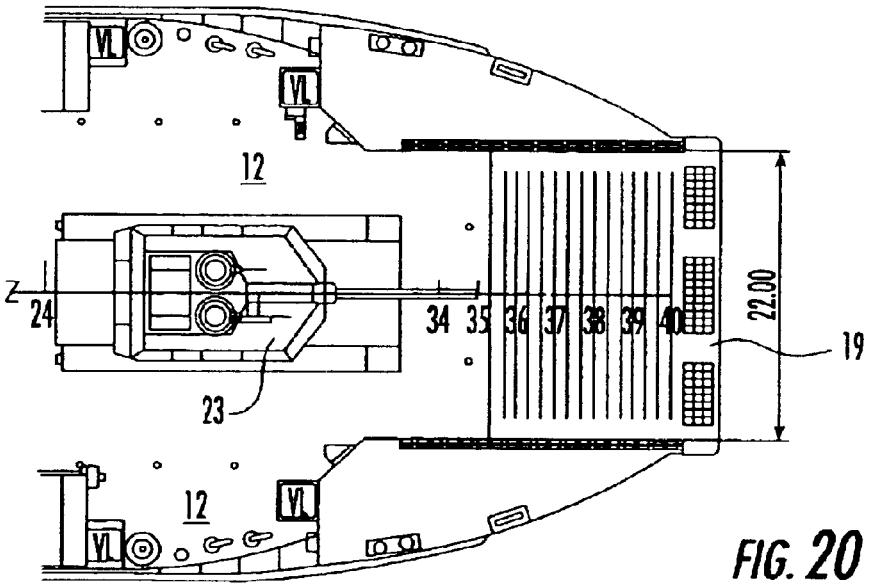
FIG. 20 is a schematic, partial plan view of the preferred embodiment of the apparatus of the present invention illustrating another typical cargo layout for the deck.

The vessel of the present invention provides an improved landing craft 10 with a hull 11 that is a planing hull. Hull 11 is powered by at least one and preferably a plurality of power units, preferably powerful engines 39 that drive waterjets 32 (see FIGS. 13 and 15). The landing craft 10 of the present invention is adapted to carry multiple large military vehicles such as tanks 23 in FIGS. 1, 20 and 23, trucks 50 as shown in. FIG. 19, or personnel carriers 51 (or other large vehicles, automobiles, etc.) as shown in FIG. 19.

Figure 17:
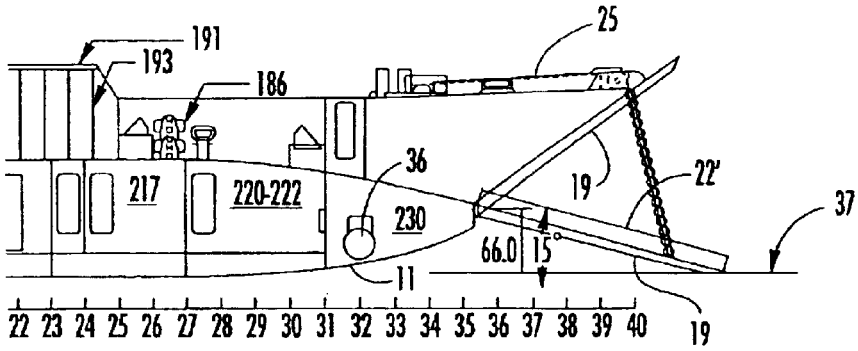
FIG. 17 is a partial cutaway elevation view of the preferred embodiment of the apparatus of the present invention.
Figure 18:
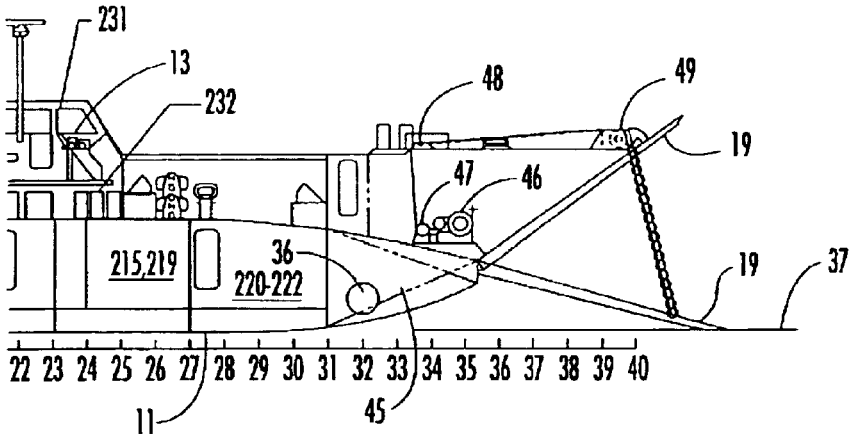
FIG. 18 is a partial cutaway elevation view of the preferred embodiment of the apparatus of the present invention.

The bow ramp 19 can be operated with a pair of spaced apart winch lines 24, 25. The winch lines 24, 25 can be powered using a winch and roller arrangement as shown in FIGS. 17 and 18 that includes winch 46 and rollers 47, 48, 49.

Figure 2:
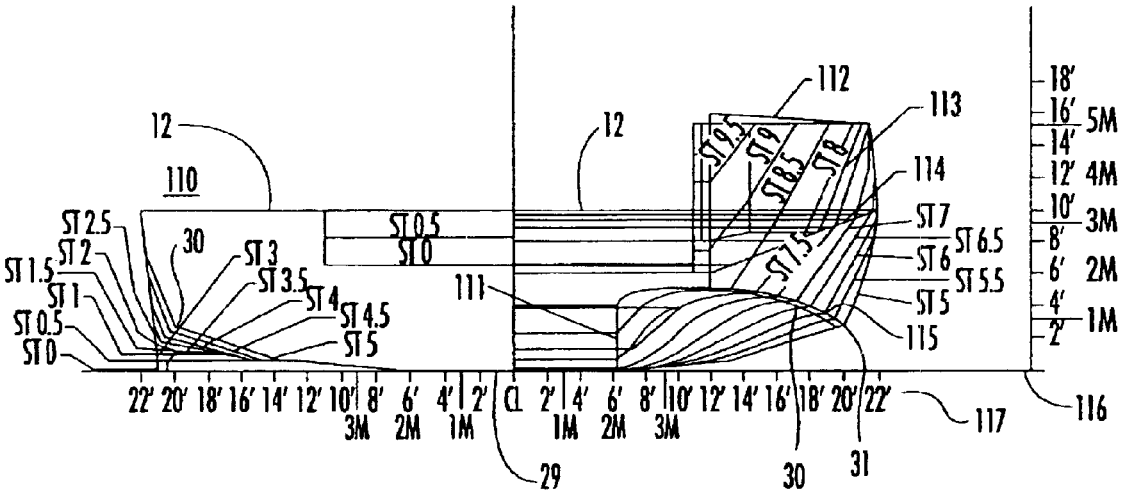
FIG. 2 is a partial sectional elevation view of the preferred embodiment of the apparatus of the present invention illustrating the hull body.
Figure 5:
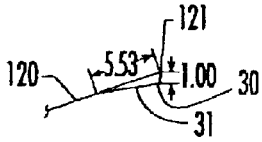
FIG. 5 is a fragmentary view of the preferred embodiment of the apparatus of the present invention showing the chine and spray rail configuration.
Figure 3:
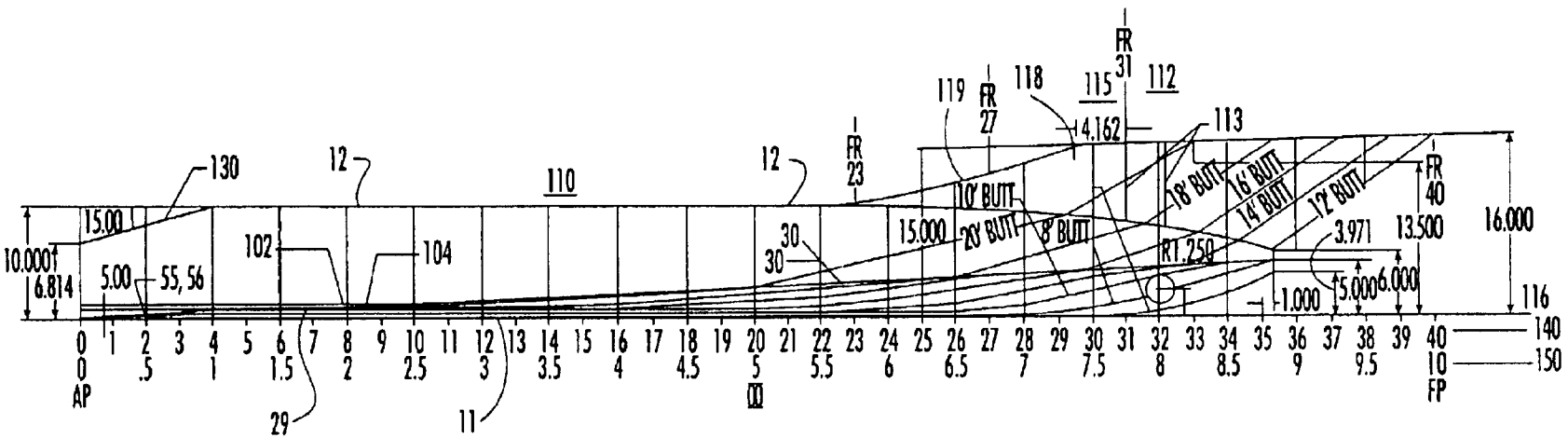
FIG. 3 is a schematic partial profile view of the hull body.
Figure 4:
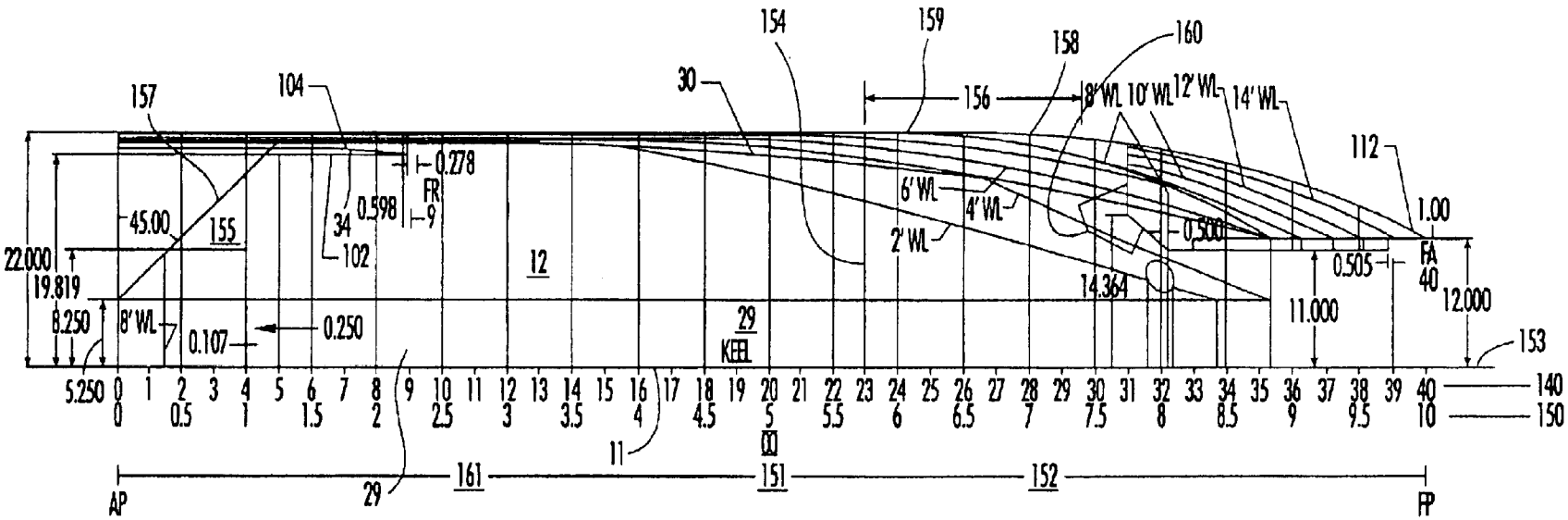
FIG. 4 is a schematic partial plan view of the hull body.
Figure 7:
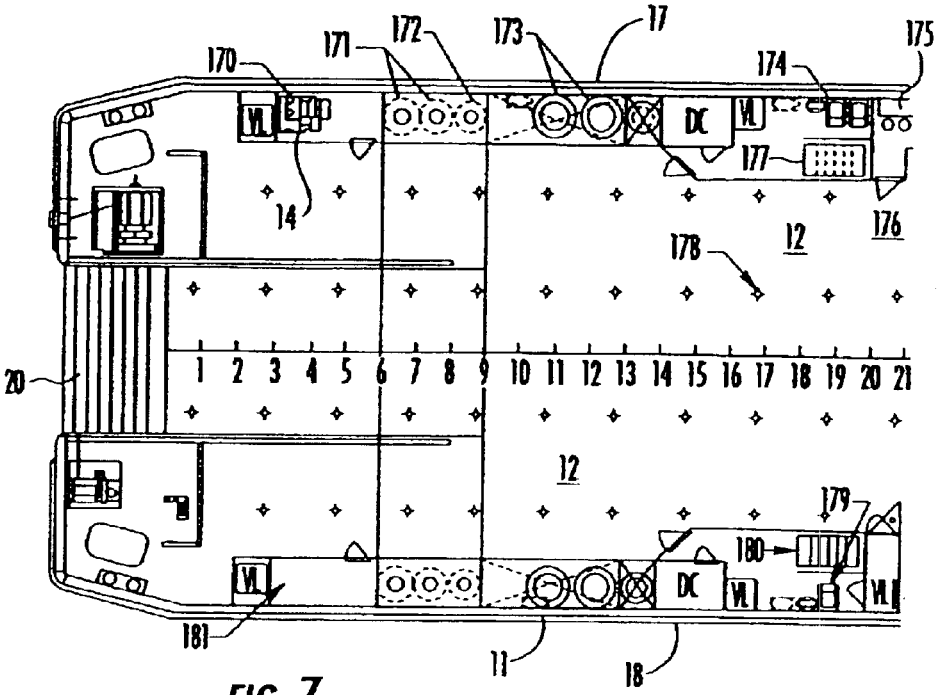
FIG. 7 is a fragmentary plan view of the preferred embodiment of the apparatus of the present invention illustrating the hull stern portion.
Figure 9:
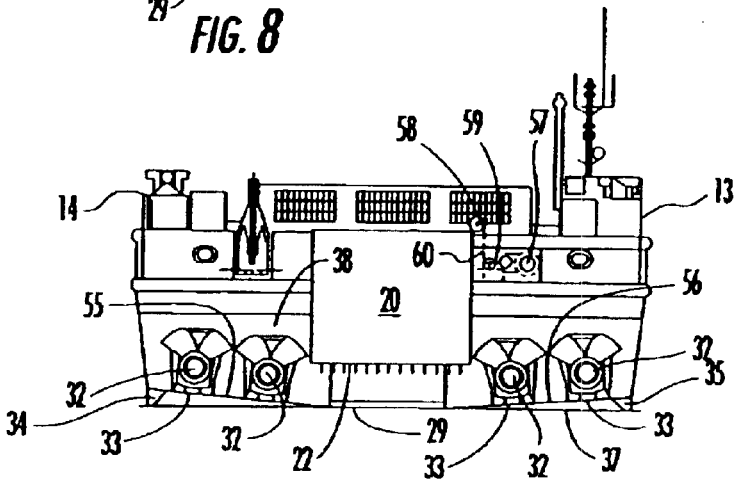
FIG. 9 is a stern elevation view of the preferred embodiment of the apparatus of the present invention.

Hull 11 includes a lower, generally flat keel 29 that communicates with planing wedges 55, 56 (see FIG. 9). A chine 30 and spray rail 31 are provided both port and starboard as shown in FIGS. 2, 3 and 4.

Figure 10:
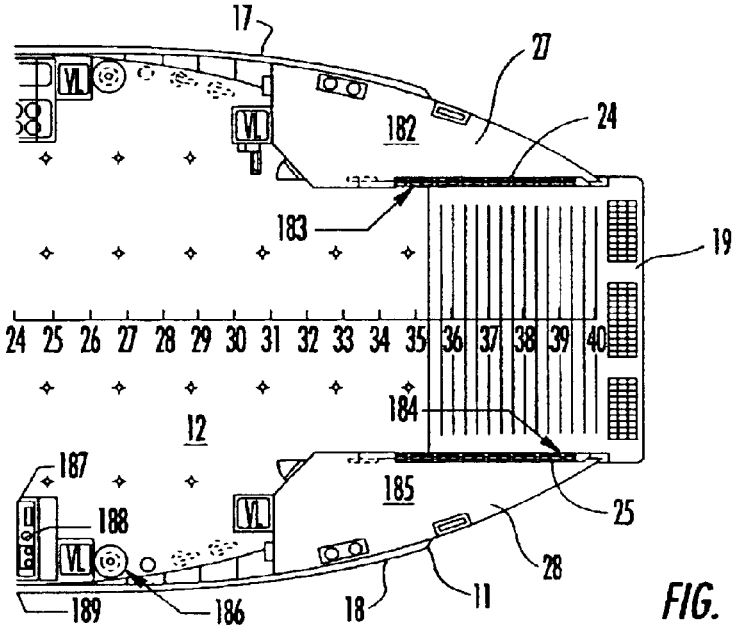
FIG. 10 is a partial plan view of the preferred embodiment of the apparatus of the present invention illustrating the bow portion thereof.
Figure 11:
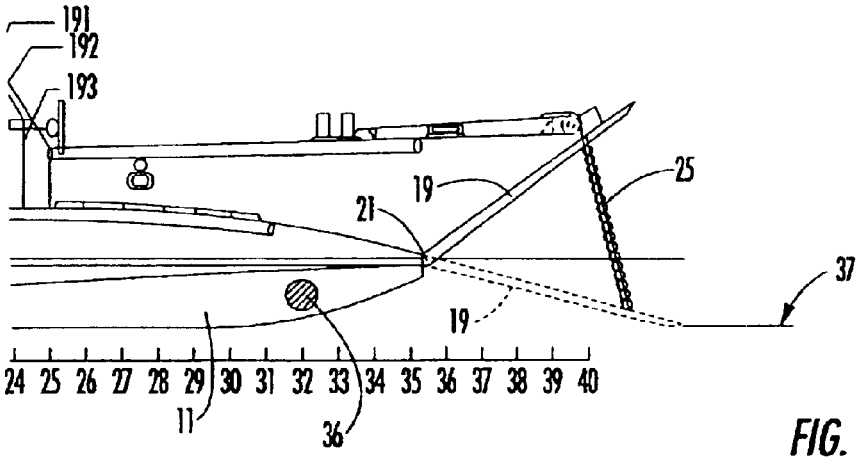
FIG. 11 is a fragmentary elevation view of the preferred embodiment of the apparatus of the present invention illustrating the bow portion thereof.
Figure 12:
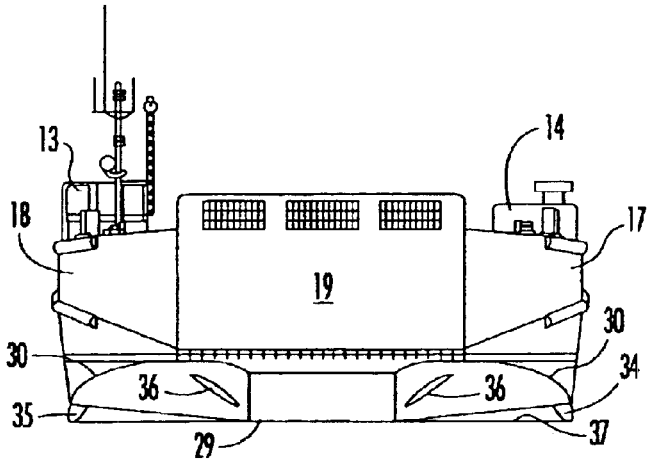
FIG. 12 is a front, elevation view of the preferred embodiment of the apparatus of the present invention.

Forecastles (commonly known as F' ocles) 27, 28 can be provided at port and starboard positions as shown in FIGS. 1 and 10. Ballast tanks are provided in both the bow 15 and stern 16 portion of hull 11 for ballasting either the bow 15 or stern 16 of the vessel during loading and unloading of vehicles 23, 50, 51. Ballast tanks can be used to help beach landing craft 10 for unloading as well as for trimming the hull 11 to remove it after it has been beached or after when docking (or leaving) the wet well 53 of a well deck ship.

One of the features of the present invention is that the engines 39 and waterjets 32 provide no moving parts externally of the hull. Water intake grates 33 (FIG. 9) enable water to be suctioned into the waterjets 32 and discharged for thrust while filtering or barring any large objects.

Figure 8:
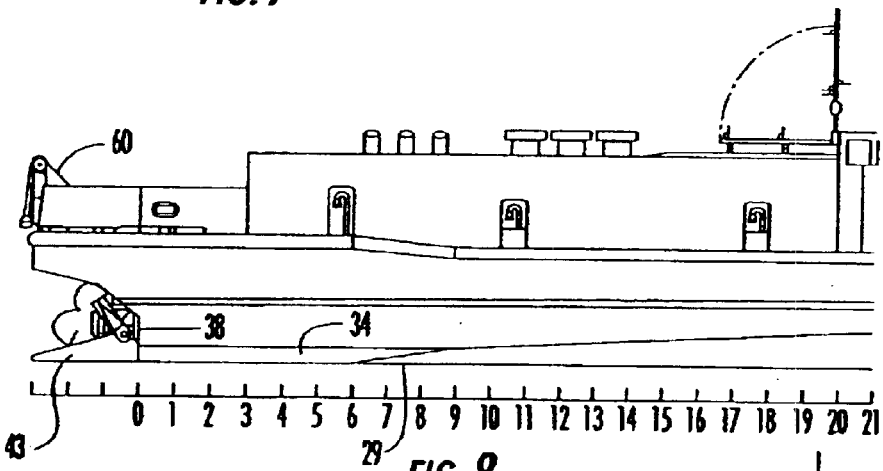
FIG. 8 is a fragmentary elevation view of the preferred embodiment of the apparatus of the present invention illustrating the hull stern portion in profile.
Figure 21:
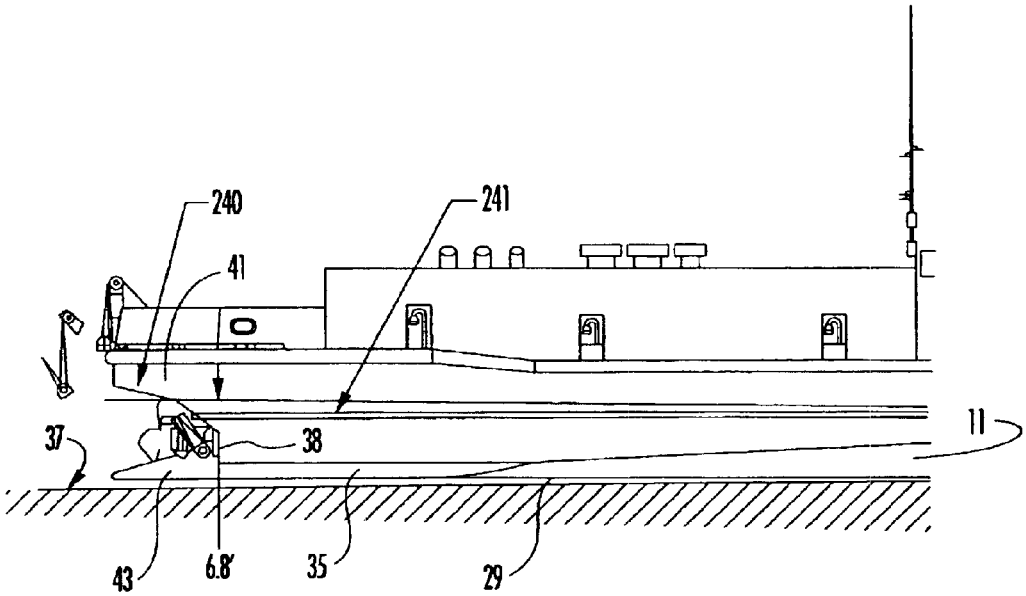
FIG. 21 is a fragmentary elevation view of the preferred embodiment of the apparatus of the present invention illustrating the stern portion when spaced from the sea bed (showing full load with maximum trim)
Figure 22:
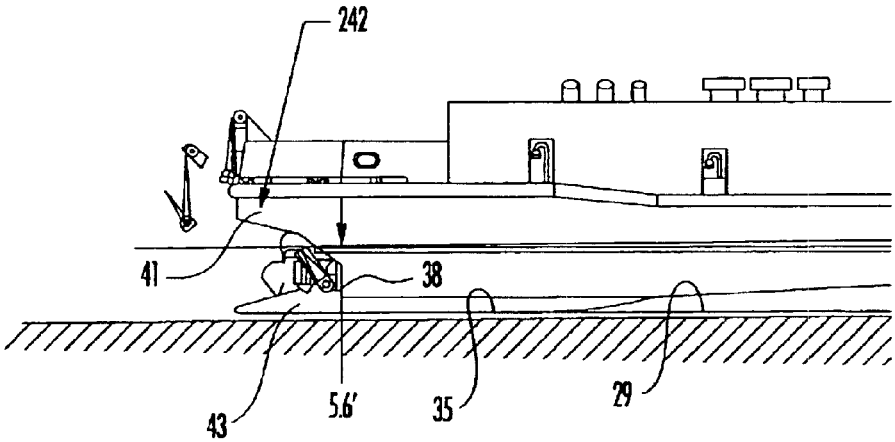
FIG. 22 is a fragmentary elevation view of the preferred embodiment of the apparatus of the present invention illustrating the stern portion when resting on the sea bed (showing no cargo)

When the vessel 10 is to beached, port and starboard groundings rails 34, 35 form a tripod arrangement with the keel flat 29 (see FIGS. 9 and 21–22). In such a tripod arrangement, the keel flat 29 and the port and starboard grounding rails 34, 35 engage the seabed 37 or wet well deck. The transom 38 is shown in FIG. 8 that also displays keel flat 29, planing wedges 55, 56, port and starboard grounding rails 34, 35. FIG. 9 shows the aft facing discharge or propulsion part of the waterjets 32.

In FIG. 8, is waterjet guard 43 extends below stern ramp 20. Guard 43 is contacted by stern ramp 20 when ramp 20 reaches a lower, unloading or loading position. The stern ramp 20 can be operated using a winch 57 and roller 58, 59 arrangement that includes a winch line 60 for raising and lowering the stern ramp 20. The jet guard 43 provides a wedge that engages any wave action, thereby stabilizing the craft 10 by helping to dampen aft pitching motions. The guard 43 has large flat surfaces that create considerable resistance forces when the guard 43 rises and falls with the transom 38 in the waves.

A bow thruster 36 can be provided for helping maneuver the landing craft 10. The combination of the bow thruster 36 and ballast tanks 40, 41, 42, 44 and 45 maneuver and help ballast the craft 10 when it is to be beached, when it is to be extracted from a beached position, or when it is to be placed into or removed from a wet well 53 of a well deep ship.

Figure 14:
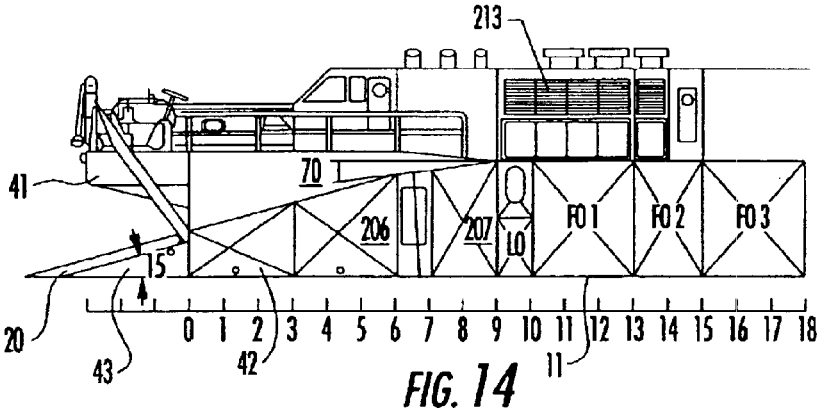
FIG. 14 is an elevation and partial cutaway view of the preferred embodiment of the apparatus of the present invention illustrating the stern portion thereof.

The ballast tanks include an aft port ballast tank 40 and an aft starboard ballast tank 41. A central ballast tank 42 can be provided in hull 11 forward of aft or stern ramp 20. The port and starboard aft ballast:tanks 40, 41 are preferably positioned on opposing sides of stern ramp 20 and behind transom 38. The port 40, starboard 41 and central 43 ballast tanks can be seen in FIGS. 13–15. Ballast tanks 44 and 45 provide port and starboard bow mounted ballast tanks for ballasting the bow of the hull 11 during loading and unloading operations.

Figure 25:
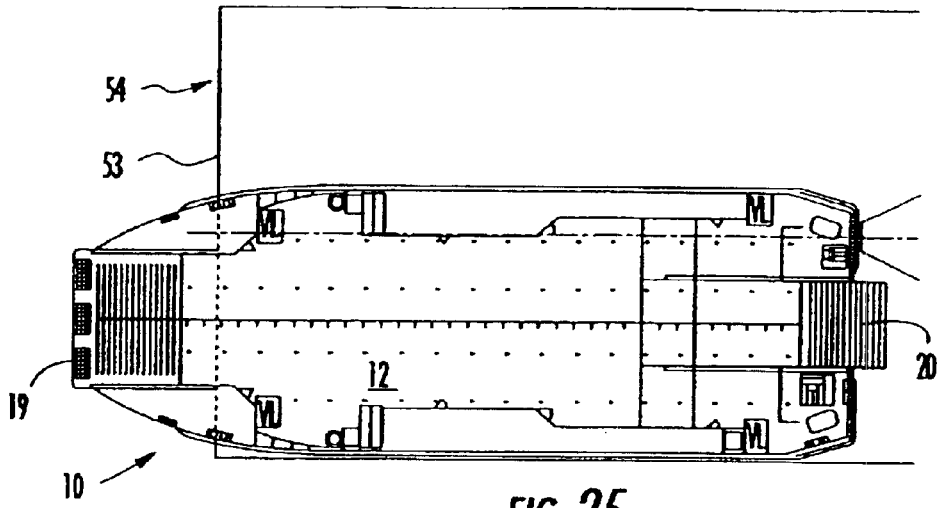
FIG. 25 is a schematic plan view of the preferred embodiment of the apparatus of the present invention illustrating its position within a wet well of a well deck ship.
Figure 26:
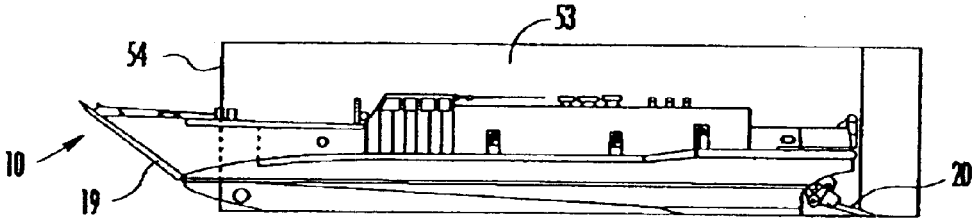
FIG. 26 is an elevation view illustrating the preferred embodiment of the apparatus of the present invention positioned in a wet well of a well deck ship.
Figure 27:
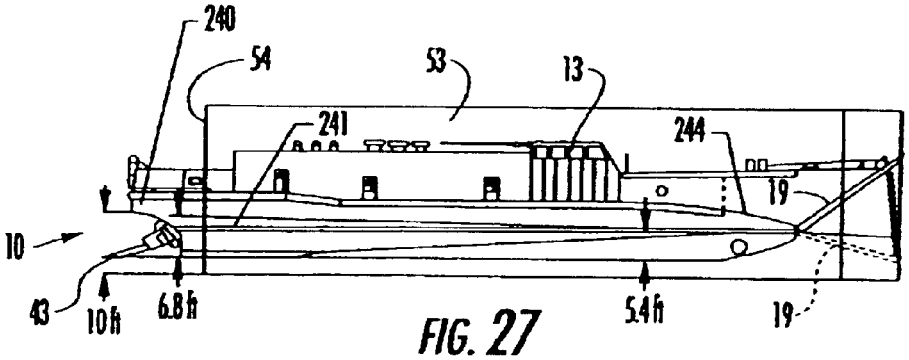
FIG. 27 is a schematic view illustrating the preferred embodiment of the apparatus of the present invention positioned in a wet well of a well deck ship.

Using the ballast tanks 40, 41, 42, 44, 45 and bow thruster 36, the landing craft 10 of the present invention can be used to load or unload equipment or vehicles while docked in a wet well vessel wet well in different orientations. In FIGS. 25 and 26, the landing craft 10 of the present invention has backed into a wet well so that the stern ramp 20 can be lowered (see FIG. 26) enabling vehicles 23, 50 or 51 or a combination thereof to be loaded via stern ramp 21 to the vessel deck 12. In FIG. 26, the landing craft 10 bow ramp 19 faces inward within a wet well 53 so that vessels can be added to the hull deck 12 via bow ramp 19. FIG. 27 shows a full load, maximum trim by stern.

Figure 28:
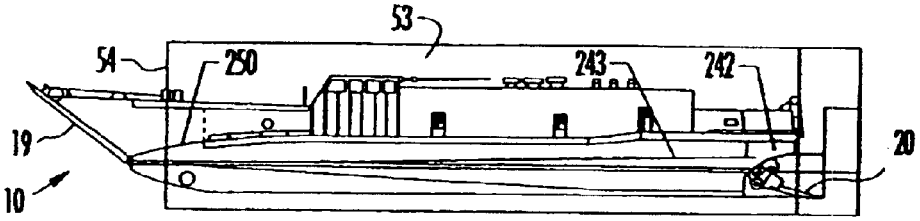
FIG. 28 is a schematic view illustrating the preferred embodiment of the apparatus of the present invention positioned in a wet well of a well deck ship (showing full load with maximum trim by bow) (LHA wet well)

In FIG. 28, the stern ramp 20 is in a lower position for receiving cargo, vehicles or the like and wherein a full load is shown with maximum trim by bow.

Figure 29:
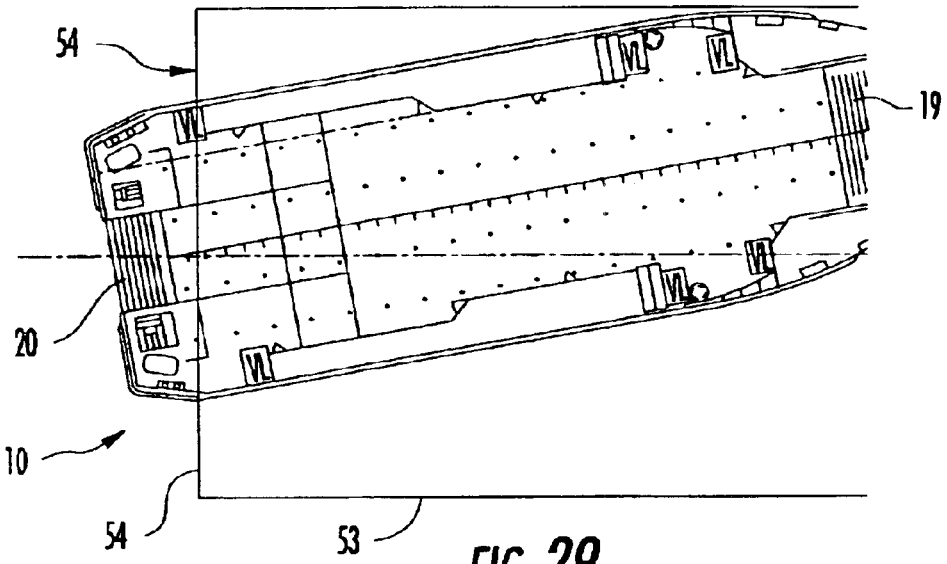
FIG. 29 is a schematic plan view of the preferred embodiment of the apparatus of the present invention illustrating (its position when in an angled orientation within a wet well of a well deck ship (LHA well)
Figure 30:
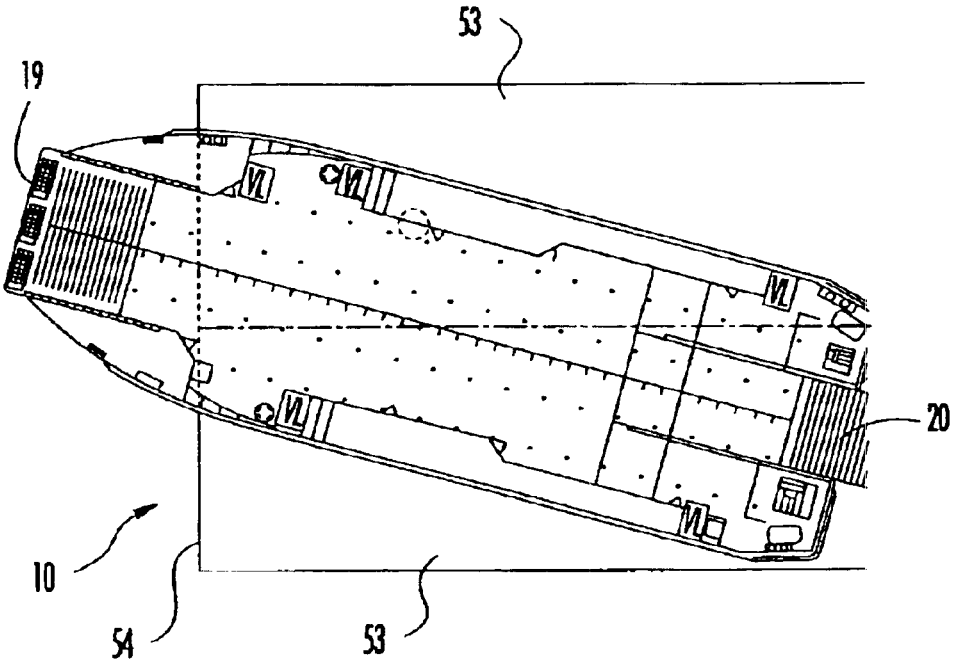
FIG. 30 is a schematic plan view of the preferred embodiment of the apparatus of the present invention illustrating its position when in an angled orientation within a wet well of a well deck ship (LHA well).

FIG. 29 shows a plan view of the landing craft 10 shown in an angled position within wet well 53 of a well deck ship. In FIG. 30, the position of the vessel hull 11 has been reversed so that the stern ramp 20 is in a position in wet well 53 in order to receive vehicles or the like for transport from the well deck ship. In FIG. 29, the stern gate 20 extends beyond stern gate 54 whereas in FIG. 30, the bow of ramp 19 extends beyond stern gate 54 of wet well 53 of a well deck ship.

Figure 23:
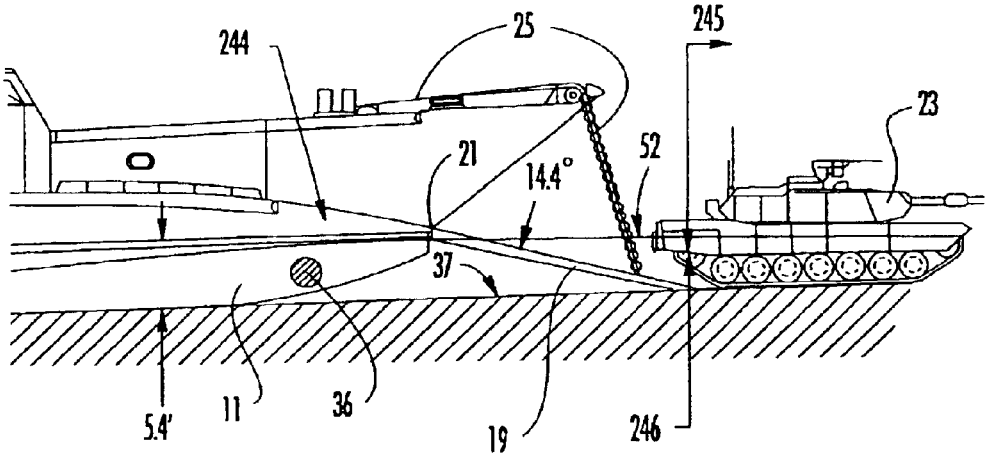
FIG. 23 is schematic elevation view of the preferred embodiment of the apparatus of the present invention illustrating a beach interface and unloading of a vehicle.
Figure 24:
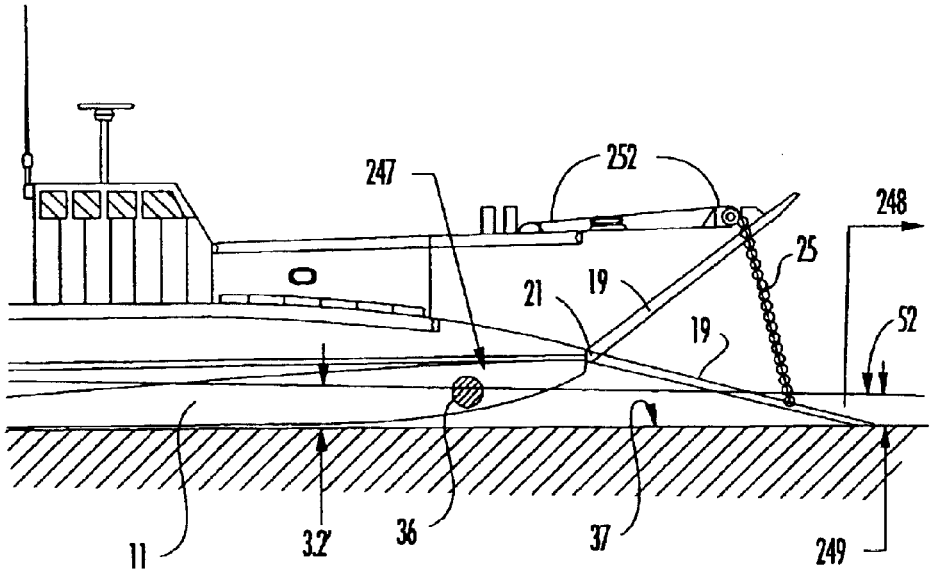
FIG. 24 is a schematic elevation view of the preferred embodiment of the apparatus of the present invention illustrating a beach interface and ramp position during unloading of equipment.

In FIG. 23, a tank 23 is shown unloading via bow ramp 19 wherein water surface 52 almost covers ramp 19. In FIG. 24, ramp 19 is only partially covered by water surface 52

Landing craft 10 can include hull 11 having a beam of between about 35 and 50 feet. Hull 11 can be made of an aluminum or steel material and can have a length of between about 130 and 150 feet. Hull 11 can be configured to be scaled to a different length and/or beam by increasing the length or width of generally flat keel 29 portion. Transom 38 can have a deadrise angle of less than 10 degrees or preferably of about 5 decrees.

Ramps 19, 20 can be positioned so that a wheeled vehicle such as a tank 23, truck, or automobile can drive through the deck 12 area by entering the deck 12 area via one of the ramps 19, 20 and leaving the deck 12 area via the other of the ramps 20, 19.

The following is a list of part numbers, parts descriptions, and materials used in the specification and suitable for use in the present invention:

PARTS LIST:

| Part Number | Description |
|---|---|
| 10 | landing craft |
| 11 | hull |
| 12 | deck |
| 13 | starboard forward control station |
| 14 | port aft control station |
| 15 | bow |
| 16 | stern |
| 17 | port side |
| 18 | starboard side |
| 19 | bow ramp |
| 20 | stern ramp |
| 21 | pivot |
| 22 | pivot |
| 23 | tank |
| 24 | winch line (port) |
| 25 | winch line (starboard) |
| 27 | forecastle |
| 28 | forecastle |
| 29 | keel flat |
| 30 | chine |
| 31 | spray rail |
| 32 | water jet |
| 33 | water intake grate |
| 34 | port grounding rail |
| 35 | starboard grounding rail |
| 36 | bow thruster |
| 37 | seabed |
| 38 | transom |
| 39 | engine |
| 40 | port ballast tank (aft) |
| 41 | starboard ballast tank (aft) |
| 42 | central ballast tank |
| 43 | waterjet guard |
| 44 | port ballast tank (bow) |
| 45 | starboard ballast tank (bow) |
| 46 | winch |
| 47 | roller |
| 48 | roller |
| 49 | roller |
| 50 | truck |
| 51 | personnel carrier |
| 52 | water surface |
| 53 | wet well |
| 54 | stern gate |
| 55 | planing wedge |
| 56 | planing wedge |
| 57 | winch |
| 58 | roller |
| 59 | roller |
| 60 | winch line |
| 102 | grounding rail upper INBD |
| 103 | baseline |
| 104 | grounding rail lower INBD |
| 110 | main deck |
| 111 | keel flat |
| 112 | foscle deck |
| 113 | end of focsle |
| 114 | main deck |
| 115 | chine & spray rail |
| 116 | baseline |
| 117 | buttocks |
| 118 | keel keel flat & 6' butt |
| 119 | knuckle |
| 120 | molded hull |
| 121 | chine & spray rail trace |
| 130 | stern ramp |
| 140 | frames |
| 150 | stations |
| 151 | length between perpendiculars = 120'–0' (36.6 m–0 m) |
| 152 | 36 inch frame spacing (0.91 m) |
| 153 | centerline |
| 154 | deck tangent |

-continued

PARTS LIST:

| Part Number | Description |
|---|---|
| 155 | ramp side |
| 156 | kuckle extent |
| 157 | planing wedge |
| 158 | focsle deck |
| 159 | knuckle |
| 160 | end of foscle |
| 161 | 12'–0' station spacing (3.7 m–0 m) |
| 170 | AFT control |
| 171 | main exhaust P/S |
| 172 | gen exhuast P/S |
| 173 | secondary intake P/S |
| 174 | folding jump seats (3) |
| 175 | galley mess table |
| 176 | galley |
| 177 | DWN hatch P/S |
| 178 | cargo tie down sockets (TYP) |
| 179 | folding jump seats (2) |
| 180 | DWN |
| 181 | EMER generator |
| 182 | deck LKR |
| 183 | chain (shown ramp up) |
| 184 | chain lock P/S chain (shown ramp down) |
| 185 | deck LKR |
| 186 | 2 spare (waterjet) impellers P/S |
| 187 | navigator |
| 188 | thrust control |
| 189 | steering |
| 190 | ballistic steel plating |
| 191 | ballistic steel plating |
| 192 | transparent armor |
| 193 | ceramic armor overlay IB, OB & FWD face of pilot house P/S |
| 200 | ballast |
| 201 | waterjet compt |
| 202 | intake compt |
| 203 | engine room |
| 204 | pumps |
| 205 | generator |
| 206 | potable water |
| 207 | waste |
| 208 | waterject compt |
| 209 | intake compt |
| 210 | engine room |
| 211 | generator |
| 212 | pumps |
| 213 | primary air intakes P/S |
| 214 | auxiliary machine space |
| 215 | stores |
| 216 | senior petty officers quarters |
| 217 | head |
| 218 | craft master |
| 219 | stores |
| 220 | forward stores |
| 221 | forward stores |
| 222 | forward stores |
| 230 | void |
| 231 | folding chart table |
| 232 | C4N bay |
| 240 | aft ballast P/S full (9.8 LT each) |
| 241 | aft ballast CL full (13.5 LT) |
| 242 | aft ballast P/S empty |
| 243 | aft ballast CL empty |
| 244 | forward ballast P/S empty |
| 245 | beach 186 feet (56.7 m) |
| 246 | fording depth 4.7 feet (1.43 m) |
| 247 | forward ballast P/S empty |
| 248 | beach 80 feet (24.4 m) |
| 249 | fording depth 2.0 feet (0.61 m) |
| 250 | forward ballast P/S full (16.6 LT each) |

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. A landing craft, comprising:

a) a planing hull having bow, stern, port and starboard portions, a hull bottom that includes a generally flat wide keel portion and port and starboard chines, a transom, and an upper deck;

b) the bull supporting one or more engines;

c) water jets powered by the engines for planing the hull;

d) a bow ramp supported by the hull and positioned at the hull bow portion, the bow ramp being movable relative to the hull between raised and lowered positions;

e) a stern ramp supported by the hull and positioned at the hull stern portion, the stern ramp being movable relative to the hull between raised and lowered positions;

f) the hull having one or more bow ballast tanks next to the bow;

g) the hull having one or more stern ballast tanks next to the stern; and h) grounding rails on the hull that form a tripod arrangement with the keel portion that ensures the craft stability while improving control and maneuverability during high speed turns when the hull is on plane.

2. The landing craft of claim 1 wherein the bow ramp moves forwardly and away from the hull when it is moved from the raised to the lowered position.

3. The landing craft of claim 1 wherein the bow ramp is pivotally attached to the hull.

4. The landing craft of claim 1 wherein the stern ramp moves rearwardly and away from the hull when it is moved from the raised to the lowered position.

5. The landing craft of claim 1 wherein the stern ramp is pivotally attached to the hull.

6. The landing craft of claim 1 wherein the hull has a beam of between about 35 and 50 feet.

7. The landing craft of claim 1 wherein the hull has a length of between about 130 and 150 feet.

8. The landing craft of claim 1 wherein the hull is configured to be scaled to a different length or beam by increasing the length or width of the generally flat keel portion.

9. The landing craft of claim 1 wherein the rear ballast tanks include port and starboard ballast tanks that are aft the transom and on opposing sides of the stern ramp.

10. The landing craft of claim 1 further comprising a jet guard on the hull stern portion that defines a wedge that helps to damp aft pitching motions initiated by waves.

11. The landing craft of claim 1 wherein the transom has a deadrise angle of less than 10 degrees.

12. The landing craft of claim 1 wherein the transom has a deadrise angle of about 5 degrees.

13. The landing craft of claim 1 wherein the hull is configured to be beached wherein the flat keel portion contacts the seabed.

14. The landing craft of claim 1 wherein the water jets are mounted just forward of the transom.

15. The landing craft of FIG. 1 wherein the hull is of a aluminum material.

16. The landing craft of FIG. 1 wherein the hull is of an steel material.

17. A landing craft, comprising:

a) a planing hull having bow, stern, port and starboard portions, a hull bottom that includes a generally flat wide keel portion and port and starboard chines, a transom, and an upper deck;

b) the hull supporting one or more power units for planing the hull;

c) a bow ramp supported by the hull and positioned at the hull bow portion, the bow ramp being movable relative to the hull between raised and lowered positions;

d) a stern ramp supported by the hull and positioned at the hull stern portion, the stern ramp being movable relative to the hull between raised and lowered positions;

e) the hull having one or more bow ballast tanks next to the bow;

f) the hull having one or more stern ballast tanks next to the stern; and g) a waterjet guard extending from the transom that engages the stern ramp when the stern ramp is lowered.

18. The landing craft of claim 17 wherein the bow ramp moves forwardly and away from the hull when it is moved from the raised to the lowered position.

19. The landing craft of claim 17 wherein the bow ramp is pivotally attached to the hull.

20. The landing craft of claim 17 wherein each ramp has a pivot and the pivots are generally parallel.

21. The landing craft of claim 17 wherein the ramps are so positioned that a wheeled vehicle can drive through the deck area by entering the deck area via one of the ramps and leaving the deck area via the other of the ramps.

22. The landing craft of claim 17 wherein the ramps are so positioned that a truck can drive through the deck area by entering the deck area via one of the ramps and leaving the deck area via the other of the ramps.

23. The landing craft of claim 17 wherein the ramps are so positioned that a tank can drive through the deck area by entering the deck area via one of the ramps and leaving the deck area via the other of the ramps.

24. The landing craft of claim 17 wherein the ramps are so positioned that an automobile can drive through the deck area by entering the deck area via one of the ramps and leaving the deck area via the other of the ramps.

25. The landing craft of claim 17 wherein the stern ramp moves rearwardly and away from the hull when it is moved from the raised to the lowered position.

26. The landing craft of claim 17 wherein the stern ramp is pivotally attached to the hull.

27. The landing craft of claim 17 wherein the hull has a beam of between about 35 and 50 feet.

28. The landing craft of claim 17 wherein the hull has a length of between about 130 and 150 feet.

29. The landing craft of claim 17 wherein the hull can be scaled to different length and beam by increasing the length or width of the generally flat keel portion.

30. The landing craft of claim 17 wherein the rear ballast tanks include port and starboard ballast tanks that are aft the transom and on opposing sides of the stern ramp.

31. The landing craft of claim 17 wherein the jet guard defines a wedge that helps to damp aft pitching motions initiated by waves.

32. The landing craft of claim 17 wherein the transom has a deadrise angle of less than 10 degrees.

33. The landing craft of claim 17 wherein the transom has a deadrise angle of about 5 degrees.

34. The landing craft of claim 17 wherein the hull is configured to be beached wherein the flat keel portion contacts the seabed.

35. The landing craft of claim 17 further comprising grounding rails on the hull that are spaced away from the generally flat wide keep portion forming a tripod arrangement that ensures craft stability when beached or when resting in the wet well of a well deck ship.

36. A landing craft, comprising:

a) a planing hull having bow, stern, port and starboard portions, a hull bottom that includes a generally flat wide keel portion and port and starboard chines, a transom, and an upper deck;

b) the hull supporting one or more power units;

c) a bow ramp supported by the hull and positioned at the hull bow portion, the bow ramp being movable relative to the hull between raised and lowered positions wherein the bow ramp inclines forwardly in front of the hull when lowered;

d) a stern ramp supported by the hull and positioned at the hull stern portion, the stern ramp being movable relative to the hull between raised and lowered positions, the stern ramp forming an obtuse angle with the generally flat keel portion;

e) the hull having one or more bow ballast tanks next to the bow;

f) the hull having a pair of stern ballast tanks that are positioned next to the stern portion of the hull and on opposing sides of the stern ramp.

37. The landing craft of claim 36 wherein the bow ramp moves forwardly away from the hull when it is moved from the raised to the lowered position.

38. The landing craft of claim 36 wherein the bow ramp is pivotally attached to the hull.

39. The landing craft of claim 36 wherein the stern ramp moves rearwardly away from the hull when it is moved from the raised to the lowered position.

40. The landing craft of claim 36 wherein the stern ramp is pivotally attached to the hull.

41. The landing craft of claim 36 wherein the hull has a beam of between about 35 and 50 feet.

42. The landing craft of claim 36 wherein the hull has a length of between about 130 and 150 feet.

43. The landing craft of claim 36 wherein the hull can be scaled to different length and beam by increasing the length or width of the generally flat keel portion.

44. The landing craft of claim 36 wherein the rear ballast tanks include port and starboard ballast tanks that are aft the transom.

45. The landing craft of claim 36 further comprising a jet guard on the hull stern portion that defines a wedge that helps to damp aft pitching motions initiated by waves.

46. The landing craft of claim 36 wherein the transom has a deadrise angle of less than 10 degrees.

47. The landing craft of claim 36 wherein the transom has a deadrise angle of about 5 degrees.

48. The landing craft of claim 36 wherein the hull is configured to be beached wherein the flat keel portion contacts the seabed.

49. The landing craft of claim 36 wherein the water jets are mounted just forward of the transom.

50. The landing craft of FIG. 36 wherein the hull is of an aluminum material.

51. The landing craft of FIG. 36 wherein the hull is of a steel material.

52. A landing craft, comprising:

a) a planing hull having bow, stern, port and starboard portions, a hull bottom that includes a generally flat wide keel portion and port and starboard chines, a transom, and an upper deck;

b) the hull supporting one or more power units;

c) a bow ramp supported by the hull and positioned at the hull bow portion, the stern ramp being movable relative to the hull between raised and lowered positions;

d) a bow facing control station for controlling the craft and bow ramp from a forward position;

e) a stern ramp supported by the hull and positioned at the hull stern portion, the bow ramp being movable relative to the hull between raised and lowered positions, the stern ramp forming an obtuse angle with the generally flat keel portion;

f) an aft facing control station for controlling the craft and stern ramp from an aft position;

g) the hull having one or more bow ballast tanks next to the bow; and h) the hull having stern ballast tanks that are positioned next to the stern portion of the hull and on opposing sides of the stern ramp.

53. The landing craft of claim 52 wherein the bow ramp moves forwardly away from the hull when it is moved from the raised to the lowered position.

54. The landing craft of claim 52 wherein the bow ramp is pivotally attached to the hull.

55. The landing craft of claim 52 wherein the stern ramp moves rearwardly away from the hull when it is moved from the raised to the lowered position.

56. The landing craft of claim 52 wherein the stern ramp is pivotally attached to the hull.

57. The landing craft of claim 52 wherein the hull has a beam of between about 35 and 50 feet.

58. The landing craft of claim 52 wherein the hull has a length of between about 130 and 150 feet.

59. The landing craft of claim 52 wherein the hull can be scaled to different length and beam by increasing the length or width of the generally flat keel portion.

60. The landing craft of claim 52 wherein the rear ballast tanks include port and starboard ballast tanks that are aft the transom.

61. The landing craft of claim 52 further comprising a jet guard on the hull stern portion that defines a wedge that helps to damp aft pitching motions initiated by waves.

62. The landing craft of claim 52 wherein the transom has a deadrise angle of less than 10 degrees.

63. The landing craft of claim 52 wherein the transom has a deadrise angle of about 5 degrees.

64. The landing craft of claim 52 wherein the hull is configured to be beached wherein the flat keel portion contacts the seabed.

65. The landing craft of claim 52 wherein the water jets are mounted just forward of the transom.

66. The landing craft of FIG. 52 wherein the hull is of an aluminum material.

67. The landing craft of FIG. 52 wherein the hull is of a steel material.

* * * * *